US005201101A

United States Patent [19]

Rouser et al.

[11] Patent Number: 5,201,101

[45] Date of Patent: Apr. 13, 1993

[54] METHOD OF ATTACHING ARTICLES AND A PAIR OF ARTICLES FASTENED BY THE METHOD

[75] Inventors: Forrest J. Rouser, San Rafael; Robert L. Erwin, Rohnert Park, both of Calif.

[73] Assignee: Minnesota Mining and Manufacturing Company, St. Paul, Minn.

[21] Appl. No.: 875,186

[22] Filed: Apr. 28, 1992

[51] Int. Cl.[5] ..... A44B 17/00

[52] U.S. Cl. ..... 24/575; 24/587; 383/64

[58] Field of Search ..... 24/575, 576, 577, 578, 24/442, 452, 399, 587; 383/64, 65

[56] References Cited

U.S. PATENT DOCUMENTS

| | | | |
|---|---|---|---|
| 281,760 | 7/1883 | Gingras . | |
| 595,510 | 12/1897 | Adams . | |
| 983,093 | 1/1911 | Svenson . | |
| 1,212,262 | 1/1917 | Rockwell . | |
| 1,214,261 | 1/1917 | Balbach . | |
| 1,342,979 | 6/1920 | Beitner . | |
| 1,887,913 | 11/1932 | Bell . | |
| 1,954,242 | 4/1934 | Heppenstall | 20/92 |
| 1,988,868 | 1/1935 | Danuff et al. | 88/17 |
| 2,144,755 | 1/1939 | Freedman | 24/587 |
| 2,206,223 | 7/1940 | Dearborn | 287/130 |
| 2,435,183 | 1/1948 | Pezzella | 160/84 |
| 2,461,201 | 2/1949 | Ellis | 2/311 |
| 2,487,400 | 11/1949 | Tupper | 150/0.5 |
| 2,499,898 | 3/1950 | Anderson | 24/206 |
| 2,558,367 | 6/1951 | Madsen | 24/201 |
| 2,632,894 | 3/1953 | Louis | 2/320 |
| 2,717,437 | 9/1955 | Mestral | 28/72 |
| 2,780,261 | 2/1957 | Svec et al. | 150/3 |
| 2,879,018 | 3/1959 | Pence | 248/28 |
| 2,895,753 | 7/1959 | Fentiman | 287/20.3 |
| 2,926,409 | 3/1960 | Perry | 24/217 |
| 3,000,658 | 9/1961 | Sprouse | 287/103 |
| 3,009,235 | 11/1961 | Mestral | 28/78 |
| 3,039,340 | 6/1962 | Livermont | 81/177 |
| 3,054,434 | 9/1962 | Ausnit et al. | 383/65 |
| 3,086,899 | 4/1963 | Smith et al. | 154/45.9 |
| 3,101,517 | 8/1963 | Fox et al. | 24/204 |
| 3,108,924 | 10/1963 | Adie | 161/127 |
| 3,173,184 | 3/1965 | Ausnit | 24/281 |
| 3,182,345 | 5/1965 | Smith | 15/176 |
| 3,192,589 | 7/1965 | Pearson | 24/204 |
| 3,198,228 | 8/1965 | Naito | 150/3 |
| 3,263,292 | 8/1966 | Fekete | 24/206 |
| 3,266,113 | 8/1966 | Flanagan, Jr. | 24/204 |
| 3,335,774 | 8/1967 | Reed | 150/5 |
| 3,353,663 | 11/1967 | Kayser et al. | 206/59 |
| 3,369,265 | 2/1968 | Halberstadt et al. | 15/22 |
| 3,372,442 | 3/1968 | Ishimatsu | 24/587 |
| 3,408,705 | 11/1968 | Kayser et al. | 24/204 |
| 3,545,048 | 12/1970 | Daddona, Jr. et al. | 24/213 |
| 3,557,105 | 5/1971 | Jones | 333/95 |
| 3,604,145 | 9/1971 | Zimmerman | 46/25 |
| 3,618,802 | 11/1971 | Yates | 215/41 |
| 3,633,642 | 1/1972 | Siegel | 150/3 |

(List continued on next page.)

FOREIGN PATENT DOCUMENTS

| | | |
|---|---|---|
| 0382420A2 | 8/1990 | European Pat. Off. . |
| 1807993 | 7/1970 | Fed. Rep. of Germany . |
| 2352676 | 4/1975 | Fed. Rep. of Germany . |
| 2127344A | 4/1984 | United Kingdom . |

OTHER PUBLICATIONS

"The Tupperware Collection," vol. 1, No. 1, Summer 1986, twenty-eight pages.

"Polytyechna entitled Self-Locking Flat Clamping Tape," one page.

*Primary Examiner*—Victor N. Sakran

*Attorney, Agent, or Firm*—Gary L. Griswold; Walter N. Kirn; Jeffrey J. Hohenshell

[57] ABSTRACT

A plurality (e.g. a pair) of misaligned, fastened articles with structured surfaces is disclosed. The structured surfaces have elements which may bend and twist during attachment resulting in a higher peel strength than when the articles are aligned. A method of attaching a pair of articles is also disclosed.

18 Claims, 7 Drawing Sheets

U.S. PATENT DOCUMENTS

| | | | |
|---|---|---|---|
| 3,689,346 | 9/1972 | Rowland | 156/245 |
| 3,703,739 | 11/1972 | Young et al. | 15/230.17 |
| 3,730,382 | 5/1973 | Heisler | 220/60 R |
| 3,742,663 | 7/1973 | Duskin | 52/145 |
| 3,780,469 | 12/1973 | Hancovsky | 46/25 |
| 3,869,764 | 3/1975 | Tanaka et al. | 24/204 |
| 3,899,805 | 8/1975 | McMillan | 24/575 |
| 3,905,174 | 9/1975 | Heisler | 53/38 |
| 3,955,245 | 5/1976 | Ballin | 24/201 |
| 4,060,089 | 11/1977 | Noiles | 128/325 |
| 4,093,009 | 6/1978 | Iavarone et al. | 150/0.5 |
| 4,244,683 | 1/1981 | Rowland | 425/143 |
| 4,329,384 | 5/1982 | Vesley et al. | 428/40 |
| 4,330,590 | 5/1982 | Vesley | 428/336 |
| 4,374,077 | 2/1983 | Kerfeld | 264/22 |
| 4,403,692 | 9/1983 | Pallacco | 206/223 |
| 4,452,356 | 6/1984 | Dahl | 206/45.32 |
| 4,520,943 | 6/1985 | Nielsen | 220/281 |
| 4,533,042 | 8/1985 | Pollacco | 206/223 |
| 4,576,850 | 3/1986 | Martens | 428/156 |
| 4,581,792 | 4/1986 | Spier | 27/575 |
| 4,775,219 | 10/1988 | Appeldorn et al. | 350/103 |
| 4,819,309 | 4/1989 | Behymer | 24/576 |
| 4,871,623 | 10/1989 | Hoopman et al. | 428/586 |
| 4,875,259 | 10/1989 | Appeldorn | 24/575 |
| 4,887,339 | 12/1989 | Bellanger | 24/575 |
| 4,959,265 | 9/1990 | Wood et al. | 428/343 |
| 4,979,613 | 12/1990 | McLaughlin et al. | 206/233 |
| 5,071,363 | 12/1991 | Reylek et al. | 439/291 |
| 5,088,164 | 2/1992 | Wilson et al. | 24/576 |
| 5,097,570 | 3/1992 | Gershenson | 24/442 |
| 5,113,555 | 5/1992 | Wilson et al. | 24/576 |

Fig. 1
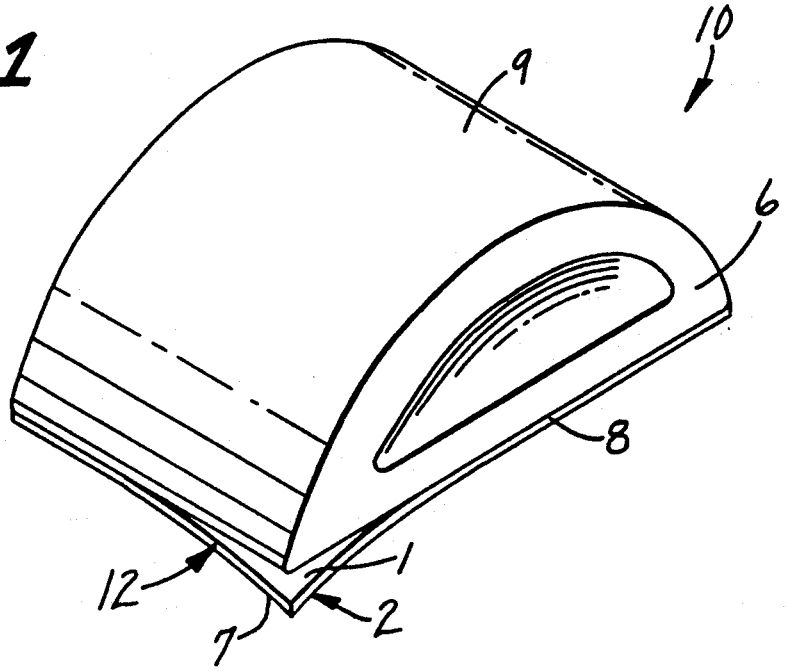
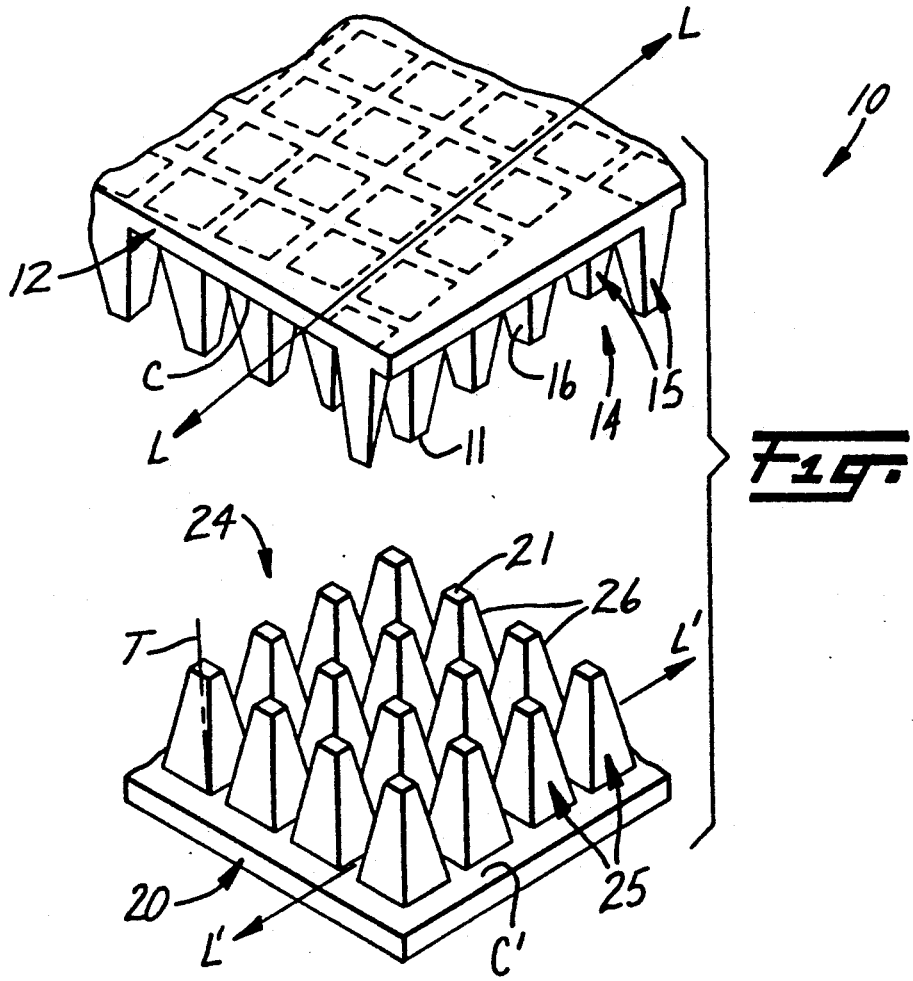
Fig. 2

METHOD OF ATTACHING ARTICLES AND A PAIR OF ARTICLES FASTENED BY THE METHOD

The present invention relates to fastened articles, and a method of attaching articles having a structured surface on one side.

BACKGROUND

The art is replete with fasteners for attaching articles together. For example, U.S. Pat. Nos. 2,717,437 and 3,009,235 to Mestra teach articles having loops and hooks. When the articles are brought into contact with each other, the hooks interlock with the loops. U.S. Pat. Nos. 2,499,898 to Anderson, 3,192,589 to Pearson, 3,266,113 to Flanagan, Jr., 3,408,705 to Kayser et al., and 4,520,943 to Nielson teach a plurality of macro asperities or protrusions, that function as an attachment means when brought into contact with similarly shaped macro asperities with correspondingly shaped recesses. Additionally, fasteners utilizing a plurality of longitudinally extending rib and groove elements which deform and mechanically interfere and resiliently interlock with each other have been disclosed in U.S. Pat. Nos. 2,144,755 to Freedman, 2,558,367 to Madsen, 2,780,261 to Svec et al., 3,054,434 to Ausnit et al., 3,173,184 to Ausnit, 3,198,228 to Naito and 3,633,642 to Siegel.

U.S. Pat. No. 4,875,259 to Appeldorn discloses several intermeshable articles. Some of the species of intermeshable articles disclosed in U.S. Pat. No. 4,875,259 require alignment before pressing the structured surfaces together. The entire contents of U.S. Pat. No. 4,875,259 are herein incorporated by reference.

DISCLOSURE OF THE INVENTION

The present invention is directed to a method of fastening articles together and the resultant fastened articles. The present invention provides fastened articles which (1) may be fastened together in a plurality of positions to afford random alignment of articles to be fastened (2) include a surprisingly strong peel strength attachment; and (3) do not require alignment prior to attachment.

According to the present invention, fastened articles are provided comprising a first and second articles each having at least one major surface at least a portion of that surface being a structured surface. The first and second articles' structured surfaces include a plurality of tapered elements. Each of the elements have at least one side inclined relative to a common plane at an angle sufficient to form a taper.

Both the first and the second articles' plurality of tapered elements are situated to form a plurality of axes including at least one first article and at least one second article longitudinal axis.

The first and second articles are fastened together with the first longitudinal axis situated at an angle relative to the second longitudinal axis. When the articles are fastened together (1) at least one of the tapered elements of the first or the second article is axially bent or torsionally flexed relative to its relaxed, unfastened position, and (2) the inclined sides of one of the first and second article's tapered elements are frictionally adhered to at least some of the inclined sides of the other of the first and second article's tapered elements.

Alternatively, the present invention may be described as a method of fastening a plurality of articles comprising the steps of: (1) providing a first article as described above, (2) situating the first article's plurality of tapered elements to form a plurality of axes including at least one first article longitudinal axis; (3) providing a second article as described above, (4) situating the second article's plurality of tapered elements to form a plurality of axes including at least one second article longitudinal axis; (5) disposing the first longitudinal axis at an angle relative to the second longitudinal axis; and (6) then pressing the structured surfaces of the first and the second article together such that after the structured surfaces are pressed together, at least one of the tapered elements of the first or the second article is axially bent and torsionally flexed relative to its relaxed, unfastened position, and such that the inclined sides of one of the first and second article's tapered elements are frictionally adhered to at least some of the inclined sides of the other of the first and second article's tapered elements.

BRIEF DESCRIPTION OF THE DRAWING

The present invention will be further described with reference to the accompanying drawing wherein like reference numerals refer to like parts in the several views, and wherein:

FIG. 1 is a perspective view of a first article in the form of an abrasive sheet and a second article in the form of an abrasive holder fastened according to the present invention;

FIG. 2 is an enlarged perspective view of separated first and second articles with their longitudinal axes misaligned, and illustrating a plurality of tapered members;

DETAILED DESCRIPTION

Figure 3:
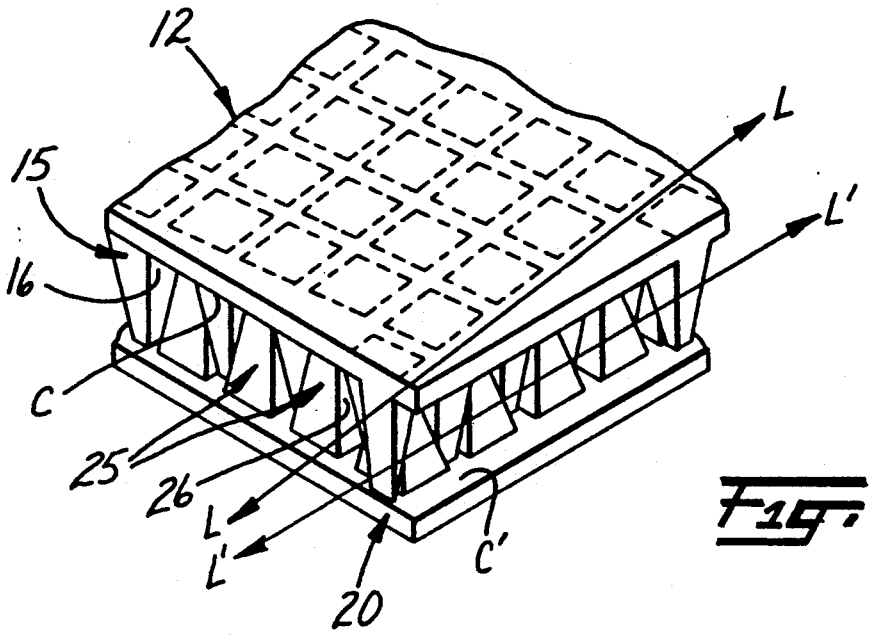
FIG. 3 is an enlarged perspective view of the first and second articles of FIG. 2 after they have been pressed to and fastened according to the present invention.
Figure 4:
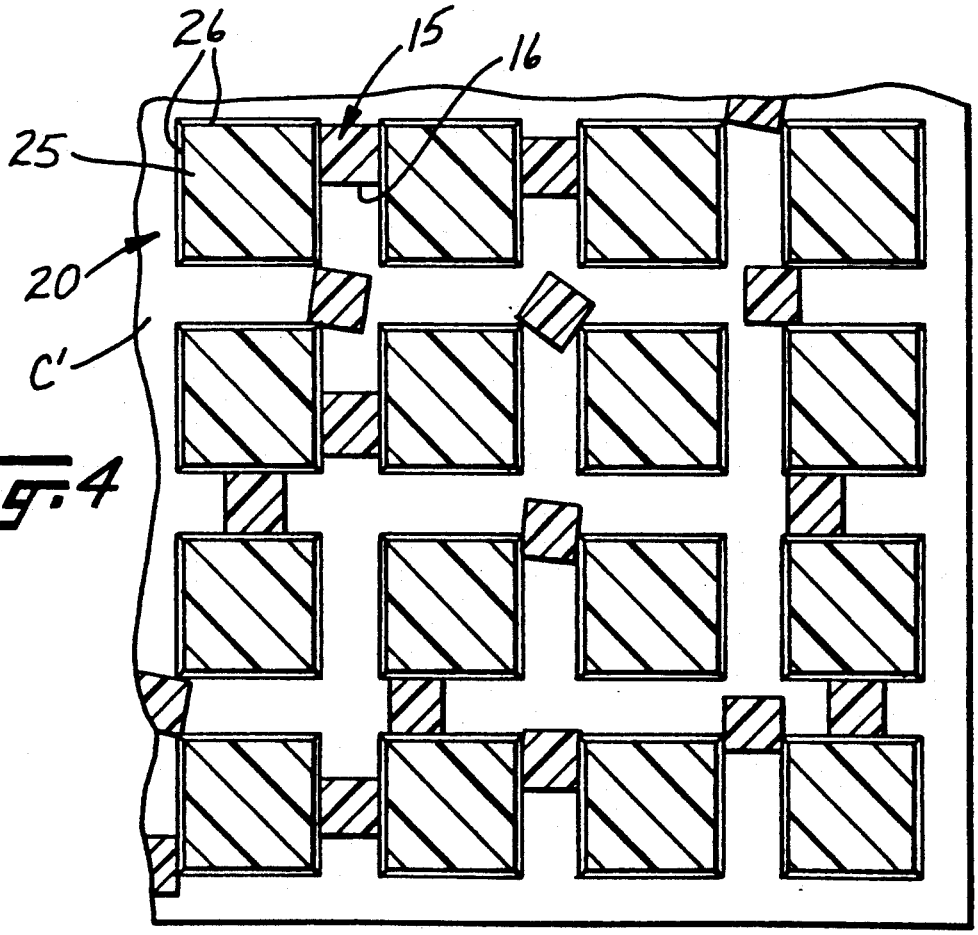
FIG. 4 is an enlarged cross-section of a pair of fastened articles similar to the articles shown in FIG. 3.

Referring now to FIGS. 2 and 3 of the drawing, there is shown a first embodiment of fastened articles generally designated by the reference character 10. The articles 10 include a first article 12 having a major surface which includes a structured surface 14. The structured surface 14 includes a plurality of tapered elements 15. Each element 15 has at least one side 16 inclined relative to a common plane C at an angle sufficient to form a taper. The tapered elements 15 are situated to form a plurality of imaginary axes including a first article longitudinal axis L.

The fastened articles 10 also include a second article 20 having a major surface which includes a structured surface 24. The structured surface 24 includes a plurality of tapered elements 25. The tapered elements 25 each have at least one side 26 inclined relative to common plane C' at an angle sufficient to form a taper. The tapered elements 25 are situated to form a plurality of imaginary axes including a second article longitudinal axis L'. The tapered elements 15 and 25 may, for example, have a shape in an unfastened position such as that shown in FIG. 2.

Preferably the axes L and L' are situated generally between periodic arrays or rows of tapered elements (e.g. 15 or 25) such that the rows are symmetrical about the axes L or L' (see e.g. FIGS. 2 and 3). However, alternatively, the axes may be situated between periodic rows of tapered elements that are not symmetrical about the axes (see e.g. axis A and FIG. 10). It should be noted that it is within the scope of the invention that the tapered elements need not be periodic and may even be arranged randomly. In a case where the tapered elements do not form a periodic arrangement (e.g. where they are randomly arranged), an imaginary axis may be arbitrarily established.

The first 12 and second 20 articles are fastened together by a method according to the present invention including the steps of: (1) providing the first article 12; (2) providing the second article 20; (3) disposing the first longitudinal axis L at an angle (theta $\theta$) relative to the second longitudinal axis L' (FIG. 2); and (4) then pressing the structured surfaces 14 and 24 of the first 12 and the second 20 article together (Fiqure 3). After the structured surfaces 14 and 24 are pressed together, (1) at least one of the tapered elements 15 or 25 of the first 12 or the second 20 article is axially bent and torsionally flexed relative to its relaxed, unfastened position (e.g. as shown in FIG. 2), and (2) the inclined sides 16 of the first article's tapered elements 15 are frictionally adhered to the inclined sides 26 of the second article's tapered elements 25.

As used in this application, the phrase "axially bent" is defined as follows: The tapered elements 15 and 25 have a relaxed shape in an unfastened position such as that shown in FIG. 2. There are no external forces acting on the tapered elements 15 or 25 in the unfastened position. In the unfastened position, the tapered elements (e.g. i5 and 25) have an imaginary longitudinal axis T (FIG. 5) which passes through the geometric center or centroid of the tapered element (e.g. 15 or 25). For example, in FIG. 5, because of the symmetrical shape of the tapered elements and the assumption that the tapered elements have a constant density, the longitudinal axis T is perpendicular to the common plane C or C'. In this application when it is said that the tapered elements are "axially bent", it is meant that the elements are deflected or deformed to a shape having an imaginary longitudinal axis T' (FIG. 5) passing through the geometric center of the deformed element which is at an angle or otherwise displaced relative to the relaxed position of the imaginary longitudinal axis T in the unfastened state.

As used in this application, torsionally flexed or twisted is defined as follows: The tapered elements 15 or 25 have a relaxed orientation in planes perpendicular to the imaginary longitudinal axis T (see FIG. 2) in an unfastened state. In this application, when it is said that the tapered elements are torsionally twisted, it is meant that the elements are radially displaced relative to their orientation in the unfastened state or position using the axis T and a corner of surface 11 as references.

Figure 5:
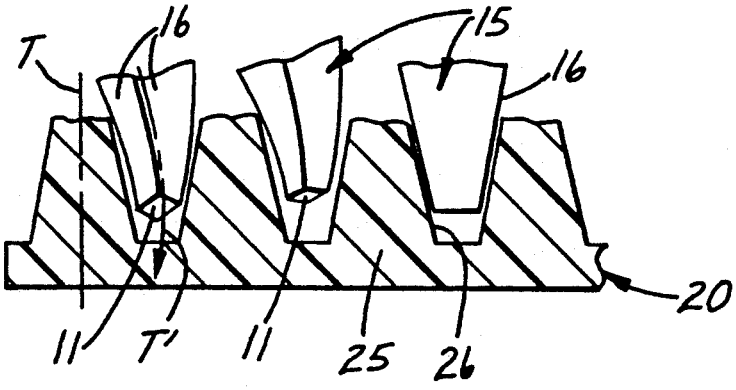
FIG. 5 is a reduced side cross-section of the articles shown partially in FIG. 4.
Figure 6:
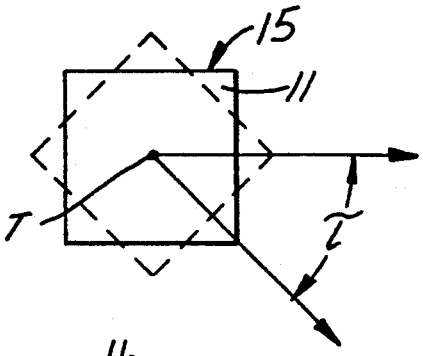
FIG. 6 is a schematic representation of the top of a flexible tapered element in an unfastened, relaxed state (solid lines) and a twisted, fastened state (dashed lines)

Referring now to FIGS. 5 and 6 there is shown an example of the first embodiment of articles shoWn in FIGS. 2 and 3 wherein the first article 12 is constructed from a relatively flexible material so that the tapered elements 15 may bend and the second article 20 is constructed from a relatively rigid material so that the elements 25 do not bend. As best seen in FIG. 5, the shape of the second article's tapered elements 25 remains generally the same in the fastened and in the unfastened position. However, the first article's tapered elements 15 both axially bend and twist.

Referring to the tapered elements 15 in FIG. 5, the elements 15 are deflected or deformed to a shape having an imaginary longitudinal axis T' passing through the geometric center of the deformed element 15 which is at an angle relative to the relaxed position of the imaginary longitudinal axis T (not shown for the element 15 in FIG. 5) in the unfastened position. Compare the positions of the imaginary axes T and T' in FIG. 5.

The elements 15 shown in FIGS. 5 and 6 also torsionally twist. As best seen schematically in FIG. 6, element 15 has an orientation in planes perpendicular to the imaginary longitudinal axis T in an unfastened state (solid lines), such as the plane which passes through the top surface 11. In the fastened position, the tapered element 15 is torsionally displaced or "twisted" (dashed lines). The element 15 is radially or torsionally displaced the angle tau relative to its orientation in the unfastened state or position using the axis T and a corner of surface 11 as references.

It should be noted that the angle tau does not necessarily correspond to the angle theta for the fastened articles. Instead, the angle tau may vary widely for different tapered elements 15 or 25 on the same article 12 or 20. If one of the articles 12 or 20 is constructed from a relatively rigid material and the other article is constructed from a flexible material (see FIG. 5), the angle tau for the rigid material is generally zero. Alternatively each of the articles 12 or 20 may be constructed from a flexible material.

Figure 15:
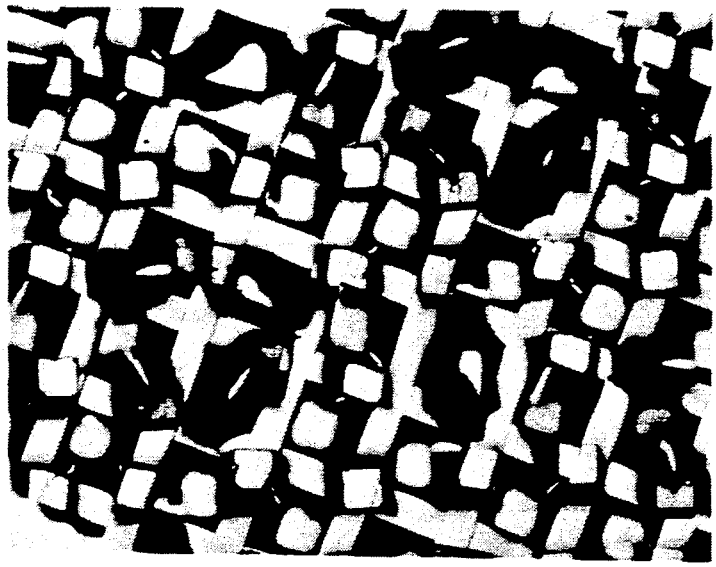
FIG. 15 is a photomicrograph taken through a Leitz Microscope at a magnification of forty times (40×) illustrating axial bent and torsional twisted pyramidal-shaped members of first and second fastened articles according to the present invention.
Figure 16:
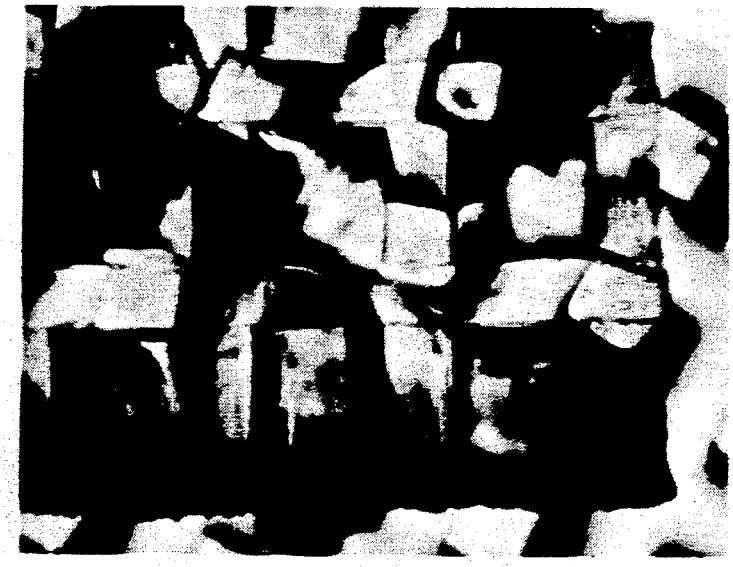
FIG. 16 is a photomicrograph taken through a Leitz Microscope at a magnification of eighty times (80×) illustrating axial bent and torsional twisted pyramidal-shaped members of first and second fastened articles according to the present invention.

FIGS. 15 and 16 are photomicrographs of first I2 and second 20 flexible fastened articles which illustrate flexible tapered elements 15 and 25 that are both axially bent and torsionally twisted or flexed.

Figure 17:
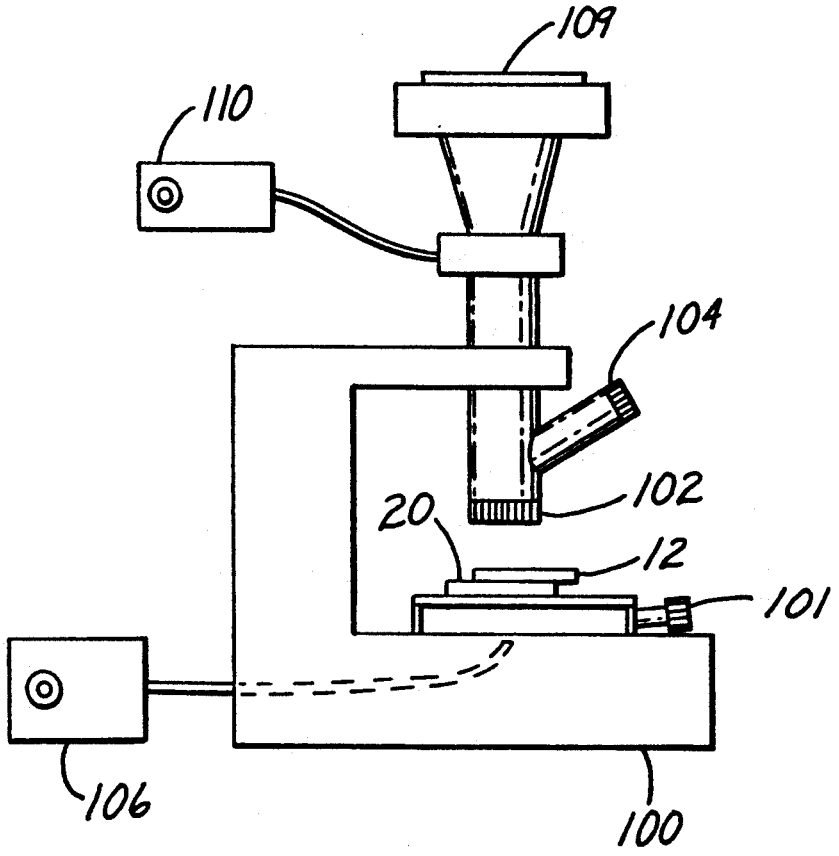
FIG. 17 is a schematic illustration showing the equipment used to take the photomicrographs of FIGS. 15 and 16.

FIG. 17 illustrates the equipment used to take the photomicrographs of FIGS. 15 and 16. Clear or transparent first and second articles 12 and 20 were provided such as described in Example 1 infra. The structures were attached to one another by the following steps: (1) The axis L & L' are misaligned. (2) The articles 12 and 20 are pressed together with moderate finger pressure. (3) The articles 12 and 20 are then placed on the tray of a Leitz Optical Microscope 100 (e.g. the Leitz Optical Microscope, generally available from Leitz of Wetzlar, Germany or Technical Instruments Co. of San Francisco, Calif.).

An X Y theta stage Boeckeler Digital micrometer (reference character 101) model 1398 generally available from TKL Inc., of Newport Beach, Calif. was provided so that a user could manipulate the position of the articles 12 and 20 relative to the microscope 100. A 1033 objective 102 and a 10× eyepiece 104 generally available from Leitz of Wetzlar, Germany or Technical Instruments Co. of San Francisco, Calif. (e.g. model no. NPL10X) were used to take the photomicrographs shown in FIGS. 15 and 16.

The microscope 100 was focused through the back of article 12 to the base of element 15 and the tip of element 25. The sample was illuminated from the bottom as shown in FIG. 17, by means of an Intralux 5000 120 volt, 180 watt light supply 106, generally available from the Volpi Manufacturing Company, Inc. of Auburn N.Y. Light passed through article 20 then 12 to the objective 102.

A camera 109 is provided. For example, the camera may be a WILD camera 109 generally available from WILD of Heerbrugg, Switzerland. The camera 109 is loaded with film such as Polaroid high speed black and white 667 film. An exposure device 110 is provided such as a Wild photomat MSP 45 generally available from WILD of Heerbrugg, Switzerland.

The camera 109 has a 0.8× magnification for a photomicrograph magnification of 80× (e.g. the photomicrograph of FIG. 16). The Wild photoautomat MPS 45 (reference character 110) controlled the exposure of the camera 109. For FIG. 15, a 5× objective was substituted.

Referring now to FIGS. 2 and 3, the angle theta $\theta$ is the angle between the axes L and L'. The angle theta $\theta$ is generally between more than zero (0) and less than about twenty (20) degrees and is preferably seven-and-one-half (7.5) degrees for reasons set forth below.

When the first 12 and second 20 articles are brought together they adhere to one another, since the inclined sides 16 of the first article's tapered elements 15 frictionally adhere to the inclined sides 26 of the second article's tapered elements 25. Because the articles 12 and 20 may be attached to one another without first aligning the articles, a user may randomly align the articles and then press them together. The multipositionable feature of articles 12 and 20 is a convenient characteristic for a user.

The structured surfaces 14 and 24 of the first 12 and second 20 articles generally comprise solid pyramidal-shaped elements having a polygonal-shaped cross-section. The phrase pyramidal-shaped elements is used herein to include truncated versions such as the frusto-pyramidal-shaped elements 15 and 25 shown in FIGS. 2 and 3. The pyramidal-shaped elements 15 and 25 generally include a polygonal-shaped cross-section such as the square shown in FIGS. 2 and 3. Alternatively, the cross-section may be rectangular, regular hexagonal, hexagonal, triangular, circular, elliptical, combinations thereof, or combinations of straight and arcuate line segments The particular material used to construct the articles 12 and 20 may be any suitable material so long as at least one of the materials affords a flexible tapered element 15 or 25 that may axially bend and torsionally twist or flex. Various materials may be used such as but not limited to commercially available acrylics, vinyls, polymers (including electron beam or radiation cured polYmers), polyethylenes and polycarbonates. Particular examples include polymethyl methacrylate, polystyrene, non-rigid polyvinyl chloride with plasticizers, and biaxially-oriented polyethylene terephthalate. Additionally, the material may be biodegradable, transparent or translucent, electrically conductive or magnetic according to the particular application. Additionally, any of the materials mentioned in U.S. Pat. No. 4,875,259 may be used, and this patent is herein incorporated by reference in its entirety.

EXAMPLE 1

Figure 8:
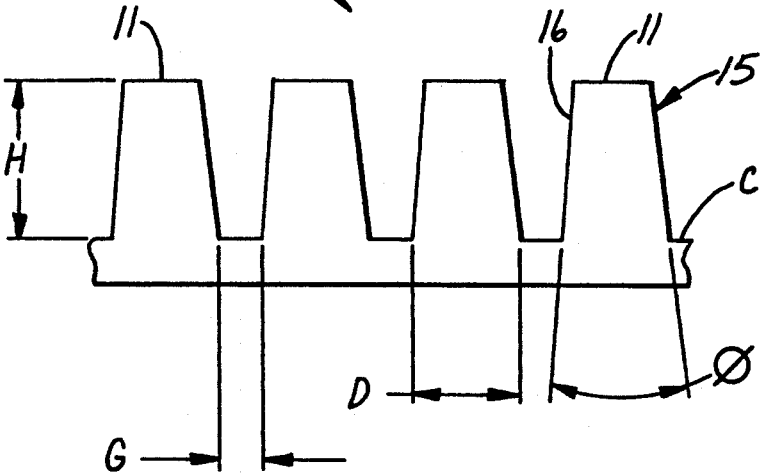
FIG. 8 is a sectional view of the structured surface of FIG. 7, with parts broken away to illustrate details of the geometry of the structured surface.
Figure 7:
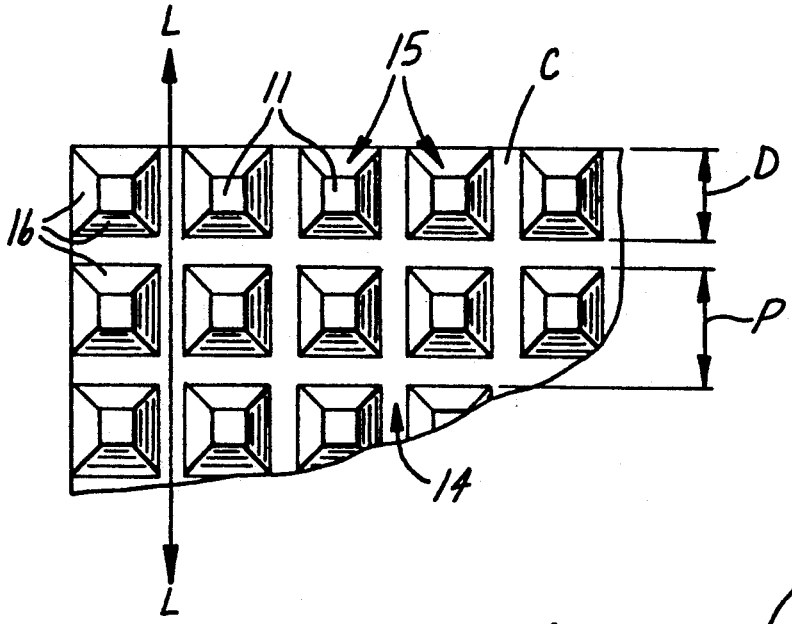
FIG. 7 is a plan view of the first embodiment of frusto-pyramidal-shaped tapered elements on the structured surface of one of the fastened articles according to the present invention which illustrates a square cross-section for the tapered members.

An example of one of the articles 12 used to provide the first embodiment of fastened articles 10 is shown in FIGS. 7 and 8. The tapered elements 15 include top surfaces or portions 11 which define a height H measured from the common plane C.

The articles in this example comprise identical, rectangular strips of PVC film with plasticizers. Each of the articles 12 and 20 were flexible and had integral, uniform flexible elements 15 and 25. The dimensions of the articles were: approximately 12.7 centimeters, (5 inches") long, about 2.54 centimeters. (1 inch") wide, and with total thickness of about 1.0–1.27 millimeters. (40–50 mils).

The articles 12 and 20 comprised polyvinyl chloride constructed from clear #516 PVC pellets obtained from Alpha Chemical and Plastics Corporation 635 Industrial Drive, Pineville, N.C. (manufacturer no. 2215-80). The articles 12 and 20 had a first broad smooth surface, and a second broad structured surface (e.g. 14 and 24) wherein the structure was of the orthogonal type having two mutually perpendicular axes of periodicity, and one longitudinal axis L or L' (as shown in FIGS. 2, 3 and 7).

The structured surfaces 14 and 24 had about a 0.63 millimeter or 25 mil groove depth or height H, a 9 degree 36 minute (rounded to 10°) included angle between tapered surfaces 16 or 26 (shown as the angle phi in FIG. 8), a pitch or lattice constant of about 0.33 millimeters, (13.08 mils) (shown as P in FIG. 7), top dimensions of approximately 0.12 by 0.12 mm. (4.86 by 4.86 mils) (e.g. the length of the sides of the top surfaces 11 or 21), and a width at the base of grooves of about 0.23 millimeters, (9.06 mils) (shown in FIG. 7 as the Diameter D). The distance G shown in FIG. 8 is simply P - D or 0.10 millimeters.

When polyvinyl chloride made from clear #516 PVC pellets obtained from Alpha Chemical and Plastics Corporation 9635 Industrial Drive, Pineville, N.C. (manufacturer no. 2215-80) was used, it was found that the flexible elements with the above mentioned dimensions twisted and bent sufficiently to enable the articles 12 and 20 to be fastened in a plurality of angular orientations.

Numerous factors affect the ability of the tapered elements 15 or 25 to bend or twist when the articles 12 and 20 are pressed together. For example, the material characteristics, the cross sectional shape of the elements 15 or 25 (e.g. square or rectangular etc.), the angle between tapered surfaces (e.g. the angle phi), the height H to diameter D ratio H/D and the pitch P to diameter D ratio P/D are all believed to affect the ability of the tapered elements to bend and twist.

All other factors held constant, the height H to diameter D ratio should be sufficient to afford bending and twisting of the elements 15 or 25. In example 1, the height to diameter ratio H/D was (0.63 millimeters/0.23 millimeters)=2.74. This H/D ratio for this material was found to work well and to provide for attachment at different angular orientations. All other factors held constant, the H/D ratio should be numerically large enough to afford flexing and twisting of the element 15 or 25. HoW ®Ver, if the ratio H/D is too large, then the tapered elements 15 and 25 bend excessively and tend to interfere with each other, thereby impeding attachment of the articles 10. If the ratio H/D is too small, then the tapered elements 15 or 25 tend to become too rigid to twist and bend and thus "bending" attachment of the articles 12 and 20 is deleteriously affected for that material.

Additionally, all other factors held constant, the pitch P to diameter D ratio P/D should be sufficient to afford bending and twisting of the elements 15 or 25. For example, in example 1, the P/D ratio is 0.33/0.23=1.43. This P/D ratio for this example was found to work well and to provide for attachment at different angular orientations. All other factors held constant, the P/D ratio should be numerically large enough to afford flexing and twisting of the element 15 or 25. However, if the ratio P/D is too large, then it is believed that the elements 15 and 25 will not twist and bend and will instead remain in or return to their unfastened position. If the ratio P/D is too small, then the tapered elements 15 or 25 tend to become too closely spaced and tend to excessively interfere with each other so that little or no bending or twisting occurs.

The articles 12 and 20 described in Example 1 were constructed in the following manner. First, a Pasadena Hydraulics, Inc., 50 Ton Model Compression Molding Press (generally available from Pasadena Hydraulics, Inc. of Pasadena, Calif.) was used. The molding surfaces were constructed to provide an article having the dimensions set forth above in Example 1. The PVC material described above was used.

The molding surfaces were constructed by first diamond cutting a UV curable polymer to provide a molding sample article having the dimensions and shape set forth above in Example 1. Optionally, any suitable acrylic plastic material may be used. Diamond turning equipment such as the Moore Special Tool Co. Model M-40 or the Pneumo Co. Model SS-156 (e.g. SN 76936) may be used to construct the molding sample article.

Of course, it will be appreciated by those skilled in the art that the fastened articles of the present invention are not necessarily individually machined but are instead produced by a replication process. Thus, to construct the molding surfaces, the molding sample mentioned above was used in a conventional electroforming process (similar to the electroforming process mentioned in U.S. Pat. No. 4,871,623 the entire contents of which are herein expressly incorporated by reference) to provide the suitable molding surface. For example, a nickel molding surface may be electroformed from the acrylic plastic sample article mentioned above.

Figure 11:
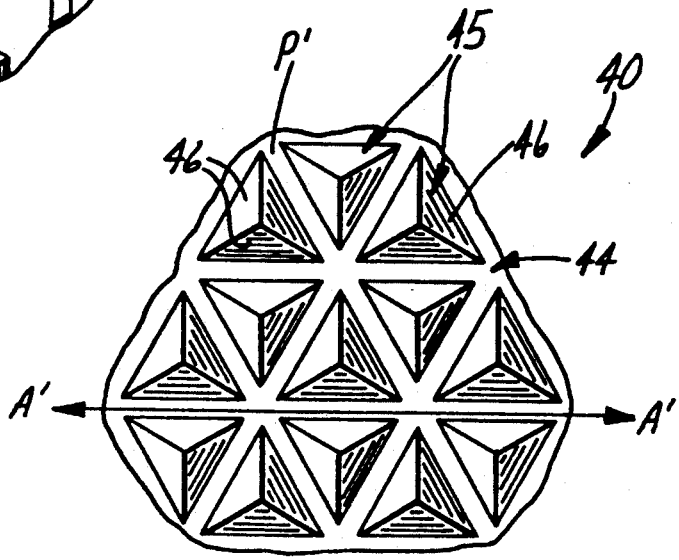
FIG. 11 is a plan view of a third embodiment of one of the fastened articles according to the present invention, illustrating a triangular cross-section for the tapered members.
Figure 12:
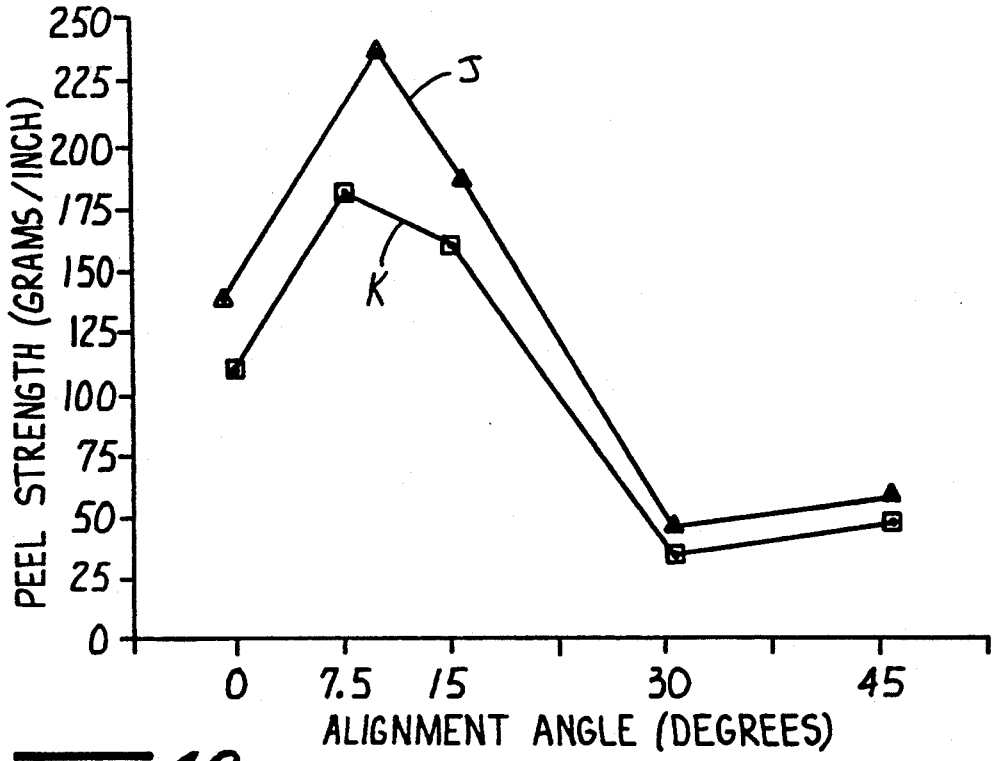
FIG. 12 is a graphical representation of the results of a peel strength test performed on a pair of fastened articles according to the first embodiment of the present invention.
Figure 14A:
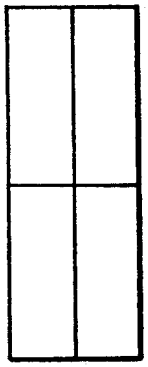
FIGS. 14A through 14E are representations of the alignments of the pair of fastened articles during the peel strength test summarized in FIG. 12.
Figure 14B:
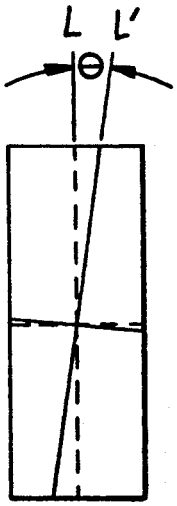
Figure 14C:
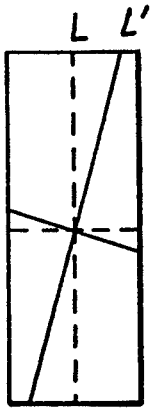
Figure 14D:
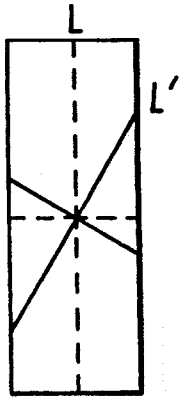
Figure 14E:
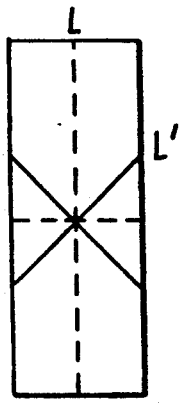

Optionally, in some structured surface designs, such as illustrated in FIG. 11, it may be advantageous to directly machine a molding surface from a metal, molding surface material, with no electroforming process. Another option may be to initially machine a surface similar to the desired molding surface in a metal material, then molding a molding sample article from the metal surface, and then electroforming the molding surface using the molding sample article.

Once the molding surfaces were constructed, the PVC pellets were then initially placed between the two molding surfaces of the Compression Molding Press. The molding surfaces of the press were heated to 350 degrees fahrenheit, after which a force of about 4350 pounds per square inch was exerted on the molding surfaces for a time period of two minutes. After two minutes, the force was increased to 45,000 pounds per square inch for a time period of two minutes.

The molding surfaces were then cooled to 100 degrees fahrenheit while a force of 45,000 pounds per square inch was maintained for a time period of ten minutes. After the ten minute time period, the 45,000 pounds per square inch force was removed. The PVC article was then removed from the molding surfaces.

There are several other methods which may be used to produce the articles 12 and 20 according to the present invention which are known in the art, such as the methods disclosed in U.S. Pat. Nos. 3,689,346 and 4,244,683 to Rowland; 4,875,259 to Appeldorn; 4,576,850 to Mertens; and U.K. Patent Application No. GB 2,127,344 A to Pricone et al. the entire contents of which are herein expressly incorporated by reference.

As stated above, the cross-section of the tapered elements need not be square. The cross-section of the tapered elements may comprise any polygonal shape including combinations of arcuate or straight lines, including but not limited to hexagons, triangles, ellipses and circles.

Figure 10:
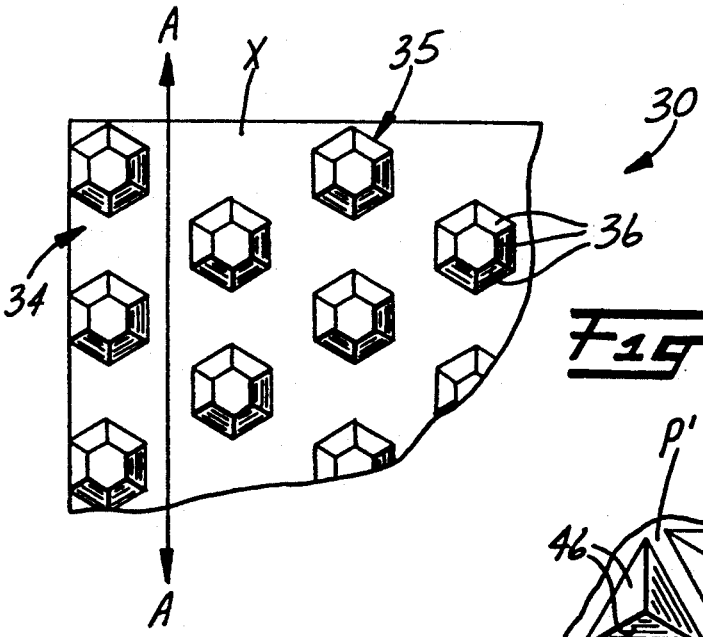
FIG. 10 is a plan view of a second embodiment of one of the fastened articles according to the present invention, illustrating a regular hexagonal cross-section for the tapered members.

FIG. 10 illustrates a second alternative embodiment of one of the fastened articles according to the present invention generally designated by the reference character 30 which has many parts that are essentially the same as the parts of the articles 12 and 20.

Like the articles 12 and 20, the article 30 includes a structured surface 34 having a plurality of tapered elements 35. Each element 35 has sides 36 inclined relative to a common plane X at an angle sufficient to form a taper. The tapered elements 35 are situated to form a plurality of axes including a first article longitudinal axis A. Unlike the tapered elements 15 and 25, the cross-section of the tapered elements 35 are regular hexagons, and the tapered elements 35 are not arranged such that they are symmetrical about the axis A.

FIG. 11 illustrates a third alternative embodiment of one of the fastened articles according to the present invention generally designated by the reference character 40 which has many parts that are essentially the same as the parts of the articles 30.

Like the article 30, the article 40 includes a structured surface 44 having a plurality of tapered elements 45. Each element 45 has sides 46 inclined relative to a common plane P' at an angle sufficient to form a taper. The tapered elements 45 are situated to form a plurality of axes including a first article longitudinal axis A'. Unlike the tapered elements 35, the cross-section of the tapered elements 45 are triangles.

It should be noted that the tapered elements 15, 25, 35 or 45 of one article may be positive elements (e.g. solid elements which project from their respective common plane C) and the elements of the other article may be negative elements (e.g. cavities which are recessed from their respective common plane C) so that the sides of the positive elements may engage with the sides of the negative elements to adhere thereto. Additionally, it should be appreciated that the cross-sectional shape of the tapered elements of the first article may be dissimilar to the cross-sectional shape of the tapered elements of the second article. For example, the hexagonal shaped tapered elements shown in FIG. 10 may be positive elements and may engage with appropriately arranged negative, triangular shaped elements (see FIG. 11).

APPLICATION AND USE

Figure 9:
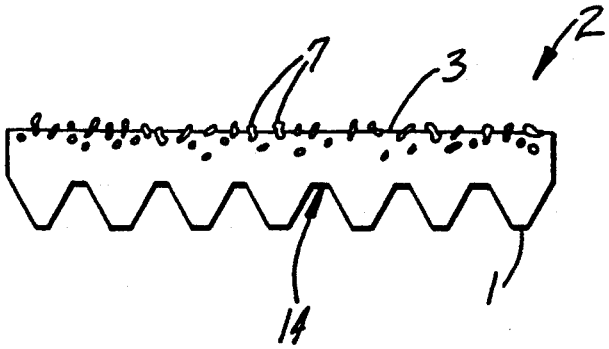
FIG. 9 is an enlarged sectional view of the abrasive sheet of FIG. 1 illustrating a structured surface on one side and an abrasive on the other side.

FIGS. 1 and 9 illustrate one of many applications for the present invention. The first article 12 may comprise a sheet of polymeric material or film 2 having first 1 and second 3 major side surfaces with the structured surfaces 14 situated on the first major side surface 1 and with an abrasive 7 situated on the second major side surface 3. The polymeric material having the abrasive 7 may be constructed according to the teachings of U.S. patent application Ser. No. 07/724,441 the entire contents of which are herein expressly incorporated by reference. For example, the film 2 may be constructed by providing a polymeric film with a structured surface on one side and with abrasive particles embedded on the other side.

FIG. 1 illustrates a manually held abrasive holder 9 which may be used as the second article 20. For example, the abrasive holder 9 may comprise a monolithic body molded from a resilient, compressible foamed polymeric material generally available from the Minnesota Mining and Manufacturing Company of St. Paul, Minn. under the trademark "Stikit". The structured surface 14 for the abrasive holder 9 may be integral with the structure of the abrasive holder 9 or, alternatively, the structured surface 24 may comprise a thin sheet or film having first and second major side surfaces with the first major side surface having a structured surface and with the second major side surface having a suitable means for mounting the film, such as a coating of repositionable pressure sensitive adhesive for adhering the film to the abrasive holder 9.

As set forth below, it has been found that, surprisingly, the peel strength characteristics of the articles 10 is greater at some angles (theta) that are more than zero degrees than the peel strength characteristic of the articles 10 at zero degrees. Thus, the side 8 (FIG. 1) of the film 2 may form the angle theta with the longitudinal axis (e.g. L) of the structured surface on the film 2; and the side 6 of the holder 9 may be generally parallel to the longitudinal axis (e.g. L') of structured surface on the holder 9. Thus, when the film 2 is pressed onto the holder 9, the user need only align the side 8 of the film 2 with the side 6 of the holder 9 to afford a convenient and quick approximation of the optimal, preferred angle theta.

TEST RESULTS

Referring noW to FIGS. 12, 13 and 14A through 14E, two articles 12 and 20 of the type described with reference to Example 1 were tested for peel strength.

A series of tests were run to determine the angular dependence of the peel force required to separate two engaged, structured surface articles 10. An Instron Model 1122 "Universal Testing Instrument", for precision testing of the mechanical properties of materials was used in the tests. The environmental test conditions were a constant temperature of 70° F. and constant relative humidity of 50%.

Test samples were identical rectangular strips of PVC film with plasticizers. The dimensions of the film are described in example 1. Each test strip had a first broad smooth surface, and a second broad structured surface wherein the structure was of the orthogonal type (the type shown in FIGS. 2 and 3) having two mutually perpendicular axes of periodicity, as described in relation to FIGS. 2, 3, 7 and 8. The structured surface was the same as that described in example 1.

Figure 13:
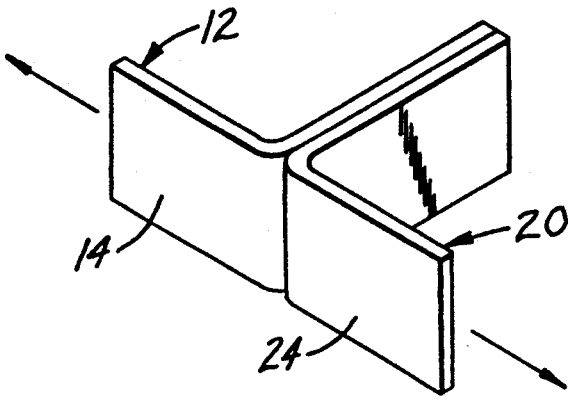
FIG. 13 is a schematic perspective view illustrating how the peel strength test of FIG. 12 was performed.

FIG. 13 schematically illustrates how articles 12 and 20 were tested using the Instron described above. Each of the articles 12 and 20 had flexible elements 15 and 25. Articles 10 were tested in pairs (e.g. 12 and 20). Each sample pair was positioned with their second structured surfaces 14 and 24 in mutual contact and with their axes of periodicity manually mis-aligned by the predetermined misalignment angle theta (0°, 7.5°, 15°, 30° or 45°, in respective tests). The misalignment angles are shown in FIGS. 14A through 14E.

Each pair of misaligned sample strips was engaged in frictional attachment by about a 20 Newton (4.5 lb.) force exerted by a smooth-rubber-surfaced metal roller with 4.4 cm. (1.75") tread-width, and a 4.76 cm. (1.875") radius. In each test, the first smooth side (e.g. the side opposite 14) of a "first" strip was fastened to a horizontal platen using a strip of tape coated on both sides with a high-tack, pressure sensitive adhesive.

The horizontal platen design permitted translational movement along a single axis in the horizontal plane. One end of the "second" strip was attached to a vertically movable member of the test instrument with the plane of the attached portion perpendicular to the horizontal axis of movement of the platen, and to the remaining frictionally attached portions of the second strip (see FIG. 13). As a result of the movable platen and during the course of each measurement, a 90° angle was maintained at the separation interface between the vertically moving portion of the second strip and the frictionally attached portion of the first strip. The peel strength tested is known as 180 degree T-peel.

The instantaneous peel force, plotted as a function of vertical position, varied as the movable strip was moved in a vertical direction. The variations were, at least in part, because the width of the separation interface varied due to the misalignment angle.

Both (1) an instantaneous peak or maximum value, and (2) an average value over a time period during which the separation interface was essentially constant, were measured in two separate runs for each misalignment angle theta. Both the instantaneous peak and average values were estimated after viewing the data providing by the Instron and the testing equipment. Both sets of peak and "time-average" values, shown in Table A, show that the maximum peel force is achieved at a misalignment angle of about 7.5°. Results of the tests are summarized in Table A, and the "statistical" average values for the two runs are set forth in Table B. The data in Table B are graphically represented in FIG. 12, with the average peel strength identified as the "K" curve and the peak peel strength identified as the "J" curve.

TABLE A

| Angle: | Test Num. | Average Peel Strength Grams per inch | Peak Peel Strength Grams per inch |
|---|---|---|---|
| 0 | 1. | 100 | 135 |
| | 2. | 120 | 145 |
| 7.5 | 1. | 185 | 240 |
| | 2. | 185 | 225 |
| 15 | 1. | 180 | 200 |
| | 2. | 150 | 175 |
| 30 | 1. | 50 | 55 |
| | 2. | 30 | 40 |
| 45 | 1. | 40 | 48 |
| | 2. | 50 | 56 |

TABLE B

Table B is an average of the values shown in Table A.

| Angle: | Average Peel Strength Grams per inch | Ave. Peak Peel Strength Grams per inch |
|---|---|---|
| 0 | 110 | 140 |
| 7.5 | 185 | 232.5 |
| 15 | 165 | 187.5 |
| 30 | 40 | 47.5 |
| 45 | 45 | 52 |

The present invention has now been described with reference to several embodiments thereof. It will be apparent to those skilled in the art that many changes or additions can be made in the embodiments described without departing from the scope of the present invention. Thus, the scope of the present invention should not be limited to the structures described in this application, but only by structures described by the language of the claims and the equivalents of those structures.

What is claimed is:

1. Fastened articles comprising:

a first article having at least one major surface at least a portion of that surface being a structured surface;

said first article's structured surface including a plurality of tapered elements, each element having at least one side inclined relative to a common plane at an angle sufficient to form a taper;

said first article's plurality of tapered elements being situated to form a plurality of axes including at least one first article longitudinal axis;

a second article having at least one major surface at least a portion of that surface being a structured surface;

said second article's structured surface including a plurality of tapered elements, each element having at least one side inclined relative to a common plane at an angle sufficient to form a taper;

said second article's plurality of tapered elements being situated to form a plurality of axes including at least one second article longitudinal axis;

wherein said first and second article's tapered elements have a shape in an unfastened position;

said first and second articles being fastened together with the first longitudinal axis situated at an angle relative to the second longitudinal axis such that at least two of said tapered elements of said first or said second article are torsionally twisted relative to their relaxes, unfastened positions, and said inclined sides of one of said first and second article's tapered elements being frictionally adhered to at least one of said inclined sides of the other of said first and second article's tapered elements, and wherein said at least two tapered elements are constructed from a flexible material.

2. Fastened articles according to claim 1 wherein:

in an unfastened position, said structured surfaces of said first and second articles comprise solid frusto-pyramidal-shaped elements having polygonal-shaped cross-sections.

3. Fastened articles according to claim 2 wherein:

said polygonal-shaped cross-sections are squares.

4. Fastened articles according to claim 2 wherein:

said polygonal-shaped cross-ections are rectangular.

5. Fastened articles according to claim 2 wherein:

said polygonal-shaped cross-section are hexagonal.

6. Fastened articles according to claim 1 wherein in an unfastened position, said structured surface of said first article comprises solid frusto-pyramidal-shaped elements having a plygonal-shaped cross-section and projecting from said common plane; and said structured surface of said second article comprises surfaces defining a cavity having a polygonal-shaped cross-section and recessed from said common plane.

7. Fastened articles according to claim 6 wherein said polygonal-shaped cross-section of said first article comprises a hexagon and said polygonal-shaped cross-section of said cavity comprises a triangle.

8. Fastened articles according to claim 1 wherein one of said first and second article's tapered elements are constructed from a polymeric material.

9. Fastened articles according to claim 8 wherein in an unfastened position, said structured surfaces of said first and second articles comprise solid frusto-pyramidal-shaped elements having a square-shaped cross-section defining a diameter and a top surface defining a height measured from said common plane, and said elements are spaced to define a pitch wherein:

said height is approximatley equal to 2.74 times the diameter;

said pitch is approximately equal to 1.43 times the diameter;

the height is measured between the common plane and a top or bottom of the element;

the diameter is measured as the length of the side of square shaped cross-sections; and the pitch is equal to the diameter plus a distance between the frusto-pyramidal-shaped elements.

10. Fastened articles according to claim 1 wherein said angle between the first and second longitudinal axes is between more than zero (0) degrees and less than about twenty (20) degrees.

11. Fastened articles according to claim 10 wherein said angle is preferably seven and one-half (7.5) degrees.

12. Fastened articles according to claim 1 wherein said first article comprises a sheet of polymeric material having first and second major side surfaces with said structured surfaces being situated on said first major side surface and with an abrasive situated on said second major side surface; and said second article comprises an abrasive holder.

13. Fastened articles according to claim 1 wherein said at least two torsionally twisted tapered elements are also bent.

14. A method of fastening articles comprising:

providing a first article having at least one major surface at least a portion of that surface being a structured surface, said first article's structured surface including a plurality of tapered elements, each element having at elast one side inclined relative to a common plane at an angle sufficient to form a taper, and each of said elements having a shape in an unfastened position, situating said first article's plurality of tapered elements to form a plurality of axes including at least one first article longitudinal axis;

providing a second article having at least one major surface at least a portion of that surface being a structured surface, said second article's structured surface including a plurality of tapered elements, each element having at least one side inclined relative to a common plane at an angle sufficient to form a taper, and each of said elements having a shape in an unfastened position;

situating said second triangle's plurality of tapered elements to form a plurality of axes including at least one second article longitudinal axis;

disposing said first longitudinal axis at an angle relative to said second longitudinal axis; and then pressing said structured surfaces of said first and said second article together such that after said structured surfaces are pressed together, at least two of said tapered elements of said first or said second article are torsionally twisted relative to their relaxed, unfastened positions, and such that said inclined sides of one of said first and second article's tapered elements are frictionally adhered to at least one of said inclined sides of the other of said first and second article's tapered elements.

15. A method according to claim 14 wherein said step of disposing said first longitudinal axis at an angle comprises the step of disposing said first longitudinal axis at an angle relative to said second longitudinal axis which is between more than zero (0) and less than about twenty (20) degress.

16. A method according to claim 15 wherein said angle is approximately 7.5 degrees.

17. A method according to claim 13 wherein said step of pressing said structured surfaces of said first and said second article together includes the step of bending at least two tapered elements.

18. A method according to claim 13 wherein the steps of providign the first and second articles include the step of constructing one of the first or second article from a flexible material.

* * * * *

UNITED STATES PATENT AND TRADEMARK OFFICE

CERTIFICATE OF CORRECTION

PATENT NO. : 5,201,101
DATED : April 13, 1993
INVENTOR(S) : Forrest J. Rouser and Robert L. Erwin It is certified that error appears in the above-indentified patent and that said Letters Patent is hereby corrected as shown below:

Col. 2, line 34, delete "to" insert --together--.
Col. 4, line 9, delete "i5" insert --15--.
Col. 4, line 34, delete "shoWn" insert --shown--.
Col. 5, line 26, delete "1033" insert --10X--.
Col. 6, line 11, after "segments" insert --.--.
Col. 6, line 18, delete "polYmers" insert --polymers--.
Col. 6, line 46, delete "635" insert --9635--.
Col. 7, line 24, delete "HoW®Ver" insert --However--.
Col. 10, line 3, delete "noW" insert --now--.
Col. 12, line 16, delete "cross-ections" insert --cross-sections--.
Col. 12, line 24, delete "plygonal" insert --polygonal--.
Col. 14, line 26, delete "providign" insert --providing--.

Signed and Sealed this
Twelfth Day of April, 1994

Bruce Lehman

BRUCE LEHMAN
*Commissioner of Patents and Trademarks*

*Attest:*

*Attesting Officer*